US008096260B2

(12) United States Patent
Murase et al.

(10) Patent No.: US 8,096,260 B2
(45) Date of Patent: Jan. 17, 2012

(54) COATING APPARATUS FOR COATING A BUILDING BOARD

(75) Inventors: Mamoru Murase, Inabe-gun (JP); Yoshinori Hibino, Ama-gun (JP)

(73) Assignee: Nichiha Corporation, Nagoya-shi, Aichi (JP)

( * ) Notice: Subject to any disclaimer, the term of this patent is extended or adjusted under 35 U.S.C. 154(b) by 146 days.

(21) Appl. No.: 12/533,118

(22) Filed: Jul. 31, 2009

(65) Prior Publication Data

US 2010/0024720 A1 Feb. 4, 2010

(30) Foreign Application Priority Data

Aug. 4, 2008 (JP) ..... 2008-201311

(51) Int. Cl.
*B05C 11/06* (2006.01)
*B05C 11/02* (2006.01)
*B05D 3/06* (2006.01)

(52) U.S. Cl. ..... 118/63; 118/62; 118/66; 118/58; 427/348

(58) Field of Classification Search ..... 118/62, 118/63, 66, 58, DIG. 4; 427/348
See application file for complete search history.

(56) References Cited

U.S. PATENT DOCUMENTS 2,770,556 A * 11/1956 Grangaard et al. ..... 118/63
3,235,401 A * 2/1966 Fowells et al. ..... 118/63
3,687,103 A * 8/1972 LaCamera et al. ..... 118/63
3,916,823 A * 11/1975 Halloran ..... 118/63
4,383,494 A * 5/1983 Schillke et al. ..... 118/50

FOREIGN PATENT DOCUMENTS

JP 10-202158 A 8/1998

* cited by examiner

*Primary Examiner* — Dah-Wei Yuan
*Assistant Examiner* — Stephen Kitt
(74) *Attorney, Agent, or Firm* — Birch, Stewart, Kolasch & Birch, LLP

(57) ABSTRACT

A coating apparatus for coating an entire surface of a building board without forming uncoated area, while conveying the building board, having: an application device for applying a coating material to the surface of the building board; a removal device for removing an excess coating material applied to the surface of the building board and forming a coating liquid film; and a pressure device for blowing air to the coating liquid film on the surface of the building board, wherein the pressure device is provided in a step posterior to a step that uses the removal device and has an air outlet which is wider than the building board and which covers the surface of the building board, and wherein the surface of the building board is applied with pressure of the atmospheric pressure or higher, while the building board is conveyed from the removable device to the pressure device.

4 Claims, 6 Drawing Sheets

COATING APPARATUS FOR COATING A BUILDING BOARD

BACKGROUND OF THE INVENTION

1. Field of the Invention

The present invention relates to a coating apparatus for coating a building board. More specifically, the present invention relates to a coating apparatus for sufficiently applying a coating material to the entire surface of a building board without forming an uncoated area, while conveying the building board.

2. Description of the Related Art

The surface of a building board usually has an uneven pattern as a design feature in order to improve the appearance of the building board. The board having the uneven pattern on the surface thereof is normally applied with a coating material in order to suppress the changes in size or other properties of the building board caused by absorption of water or to further improve the appearance of the building board.

As an apparatus for applying a coating material to the building board, there are a brushing apparatus for applying a coating material using a brush applied, a roll coater apparatus where a part of the surface of a rotating roll coater is dipped in a coating reservoir to apply the coating material thereof to the roll surface, and the coating material is moved by means of the roll, a spray apparatus for applying a coating material by spraying the coating material through a nozzle at the end of the spray, and a flow coater apparatus that allows a coating material to flow down from a side wall of a coating reservoir to form a film and applies the coating material by allowing a building board to pass through the film-like coating material.

The brushing apparatus is an apparatus in which the brush is dipped in the coating reservoir to apply the coating material to the brush, and then the coating material is applied to a building board by brushing the surface thereof using the brush. In this apparatus it is difficult to brush the surface of the building board with the brush evenly, and to apply the coating material to the building board while conveying the building board. Furthermore, application of the coating material is even more difficult with a large building board or a building board that has an uneven pattern on the surface thereof. Thus, there is a concern that some sections of the surface of the building board might not be applied with the coating material sufficiently, impinging on the properties or appearance of the building board. Moreover, bringing the brush into direct contact with the building board causes hard wear and deformation, in which case the brush needs to be replaced immediately.

In the roll coater apparatus, application of the coating material can be performed while conveying a building board to be coated, because the coating material applied to the roll is moved to a section on the building board that comes into contact with the roll. Also, when the surface of the building board is smooth, the coating material is moved and applied to the building board surface sufficiently. However, when the building board has an uneven pattern on the surface thereof, the roll cannot be brought into contact with the concave portions. Therefore, the coating material cannot be moved to the concave portions and consequently some sections on the surface of the building board cannot be applied with the coating material, impinging on the properties or appearance of the building board. Furthermore, when circulating the coating material, fragments or the like of the base material of the building board are most likely to be mixed into the coating material, in which case the fragments adhere to the roll, whereby some sections on the surface of the building board might not be applied with the coating material. In addition, the viscosity of the coating material to be used needs to be managed because the viscosity of the coating material affects the coating condition of the coating material.

In the spray apparatus, the coating material can be applied to a building board while conveying the building board, because the coating material is sprayed to the surface of the building board. Therefore, the coating material can be applied to even a building board that has an uneven pattern on the surface thereof. However, the amount of coating material varies between the concave portions and the convex portions. Therefore, the inclined surfaces of the concave and convex portions cannot be applied with the coating material sufficiently, and the coating material forms a pool in each concave portion, impinging the properties or appearance of the building board. Furthermore, when circulating the coating material, fragments or the like of the base material of the building board are most likely to be mixed into the coating material, in which case the fragments cause nozzle clogging, whereby some sections on the surface of the building board might not be applied with the coating material.

In the flow coater apparatus, the coating material can be applied evenly to a building board having a smooth surface. However, in the case of a building board having an uneven pattern on the surface thereof, a flow coater apparatus can apply the coating material to the inclined surfaces of the concave and convex portions that are provided on the conveyance traveling direction side, but cannot apply the coating material to the inclination surfaces of the concave and convex portions that are provided on the opposite side of the conveyance traveling direction, whereby some sections on the surface of the building board are not applied with the coating material, impinging on the properties or appearance of the building board. Furthermore, when circulating the coating material, bubbles are generated in the coating material and break the film-like coating material, whereby some sections on the surface of the building board might not be applied with the coating material. In addition, fragments or the like of the base material of the building board are most likely to be mixed into the coating material, in which case the fragments clog the side wall of the coating reservoir, whereby some sections on the surface of the building board might not be applied with the coating material.

In order to solve the problems described above, there is a method for applying a large quantity of coating material to a surface of a building board, but applying a large quantity of coating material generates bubbles in a coating liquid film or causes accumulation of the coating material in the concave portions on the surface of the building board. When the coating material accumulates in the concave portions of the surface, bubbles and coating irregularity are caused in a drying step, degrading the quality or appearance of the product. As a solution to these problems, Japanese Patent Application Publication No. H10-202158 discloses an apparatus that performs flow coating on a coated surface and thereafter blows air from behind the coated surface in its moving direction. However, although this apparatus eliminates the bubbles generated on the coating liquid film, the apparatus does not eliminate the risk of accumulation of the coating material in the concave portions on the surface of the building board.

SUMMARY OF THE INVENTION

The present invention was contrived in view of the above circumstances, and an object of the present invention is to provide a coating apparatus for sufficiently applying a coating material to the entire surface of a building board having an uneven pattern on the surface thereof, without forming an uncoated area, while conveying the building board.

In order to achieve the above object, an invention described in claim 1 is a coating apparatus for coating a surface of a building board while conveying the building board with the surface facing upward, the coating apparatus having: an application device for applying a coating material to the surface of the building board; a removal device for removing an excess coating material applied to the surface of the building board and forming a coating liquid film; and a pressure device for blowing air to the coating liquid film on the surface of the building board, wherein the pressure device is provided in a step posterior to a step that uses the removal device and has an air outlet which is wider than the building board and which covers the surface of the building board, and wherein the surface of the building board is applied with pressure of the atmospheric pressure or higher, while the building board is conveyed from the removable device to the pressure device.

The application device is configured by a spray and/or a flow coater, and/or a device applying the coating material by gravity-dropping the coating material, and is capable of excessively applying the coating material to the surface of the building board. In order to apply the coating material to the entire surface of the building board without forming an uncoated area, it is preferred that the application device apply the coating material in an amount of 50 to 200 g/square 'shaku' (11.93 inches or 303 mm). The removal device is configured by a scraping device such as an air knife for blowing high-pressure air and/or a roll coater.

In the present invention, because the application device and the removal device are provided, not only is it possible to sufficiently apply the coating material to the surface of the building board without forming an uncoated area, but also to obtain the uniformity in the thickness of the coating liquid film formed on the surface of the building board. In addition, because the pressure device is provided and the surface of the building board is applied with pressure of the atmospheric pressure or higher, while the building board is conveyed from the removable device to the pressure device, the coating material is pressed in an internal direction of the surface of the building board and thereby fills fine concave and convex portions on the surface of the building board. Consequently, the thickness of the coating liquid film formed on the surface of the building board can be further uniformed and the adhesion of the coating material to the building board can be improved. Furthermore, because the pressure device has the air outlet that is wider than the building board and covers the surface of the building board, the air can be blown reliably on the surface of the building board. In addition, because the pressure device is located behind the removal device and above the building board, the coating material is spattered easily by the removal device, but the air outlet of the pressure device can prevent the spattered coating material from adhering to the surface of the building board.

An invention described in claim 2 is the coating apparatus for coating a building board according to claim 1, wherein the air outlet of the pressure device also covers a lateral face of the building board.

In this invention, because the air outlet of the pressure device blows the air while covering the surface and lateral face of the building board, the air can be blown reliably on the surface and lateral face of the building board. Further, the air outlet is located behind the removal device and covers the surface and lateral face of the building board, and the coating material is spattered easily by the removal device, but the air outlet can prevent the spattered coating material from adhering to the surface and lateral face of the building board.

An invention described in claim 3 is the coating apparatus for coating a building board according to claim 1 or 2, wherein the pressure device further has a straightening plate.

In this invention, because the pressure device has a straightening plate, the air can be straightened by the straightening plate so that the air can be blown from the air outlet onto the coating liquid film formed on the surface of the building board. Therefore, the air can be reliably blown out on the entire surface of the building board.

An invention described in claim 4 is the coating apparatus for coating a building board according to claim 1, the coating apparatus further having a decompression device for decompressing a back side of the building board, wherein the decompression device is provided below the pressure device and the building board.

In this invention, because the decompression device is provided below the pressure device and the building board, the air can be blown on the coating material on the surface of the building board, and the back side of the building board is decompressed. Consequently, the coating material is pressed in the internal direction of the surface of the building board and at the same time pulled toward the back side. Therefore, the fine concave and convex portions of the surface of the building board can be filled with the coating material more easily, and the thickness of the coating liquid film formed on the surface of the building board can be further uniformed, thereby further improving the adhesion of the coating material to the building board.

An invention described in claim 5 is the coating apparatus for coating a building board according to claim 4, wherein a work distance of the pressure device is longer than a work distance of the decompression device.

As described above, the pressure device has the air outlet that is wider than the building board and capable of covering the surface of the building board. In this invention, because the work distance of the pressure device is longer than the work distance of the decompression device, the decompression device is activated in a state in which the air outlet of the pressure device covers the upper side, whereby the air can be drawn stably at the time of decompression.

An invention described in claim 6 is the coating apparatus for coating a building board according to claim 1, wherein the pressure device has a coating stopper at a front end part of the pressure device.

The coating stopper is obtained by bending the front end part at 90 degrees or by forming an angle having an L-shaped cross section.

In this invention, the pressure device has the coating stopper at the front end part of the pressure device. Thus, when the coating material that is spattered by the removal device adheres to an upper surface of the pressure device, the adhering coating material can be prevented from dripping from the front end part and adhering to the surface of the building board.

The coating apparatus of the present invention is capable of sufficiently applying the coating material to the entire surface of a building board having an uneven pattern on the surface thereof, without forming an uncoated area, while conveying the building board, and of obtaining the uniformity in the thickness of a coating liquid film formed on the surface of the building board. The coating apparatus according to the present invention can further improve the adhesion of the coating liquid film to the building board. The coating apparatus according to the present invention can also prevent the spattered coating material from adhering to the surface of the building board.

DESCRIPTION OF THE PREFERRED EMBODIMENTS

An embodiment of the present invention is described hereinafter. First, an example of the equipment having a coating apparatus of the present invention is described, and then a coating method using the equipment is described.

Embodiment 1

Figure 1:
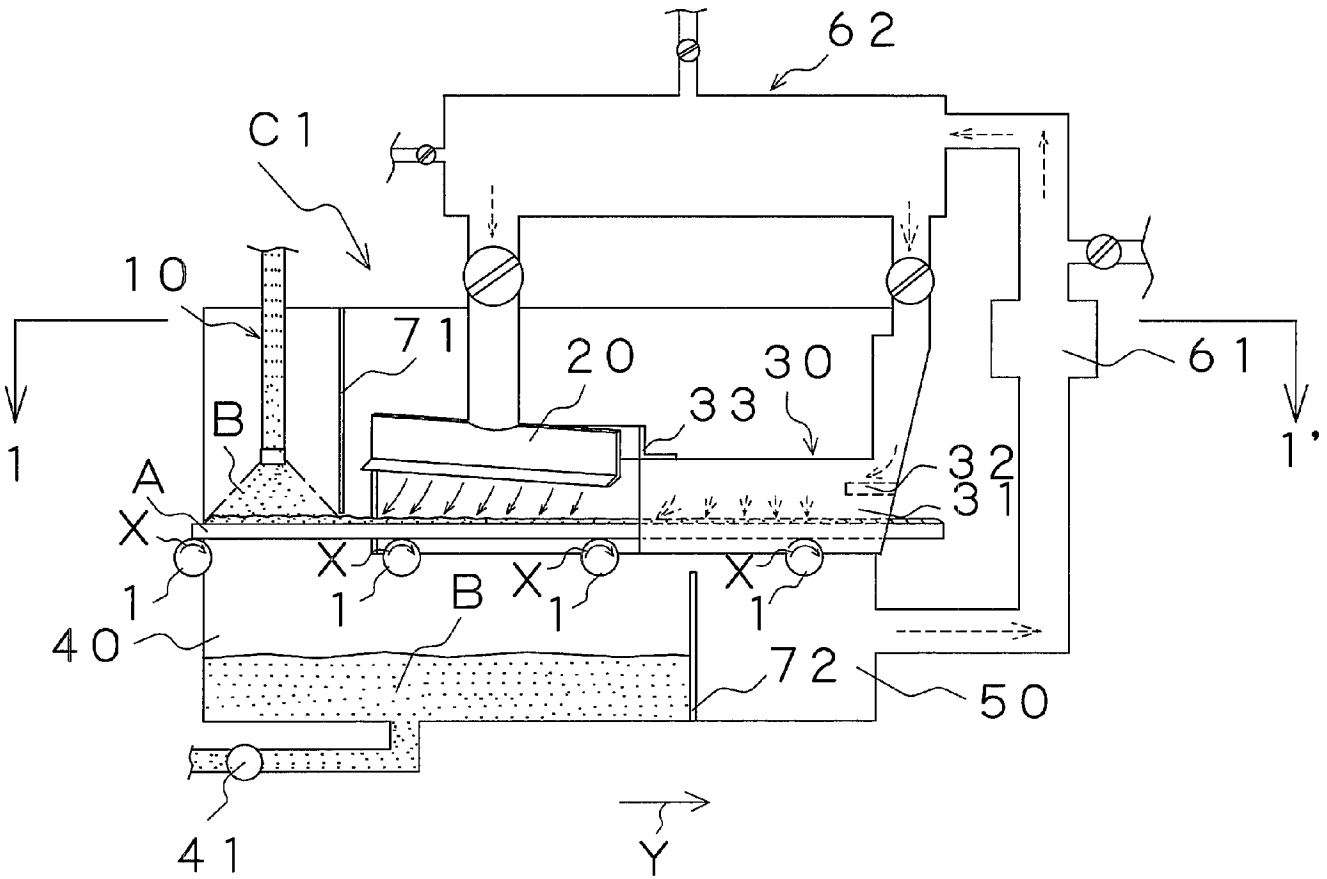
FIG. 1 is a side cross-sectional diagram showing an example of the equipment having a coating apparatus of the present invention.
Figure 2:
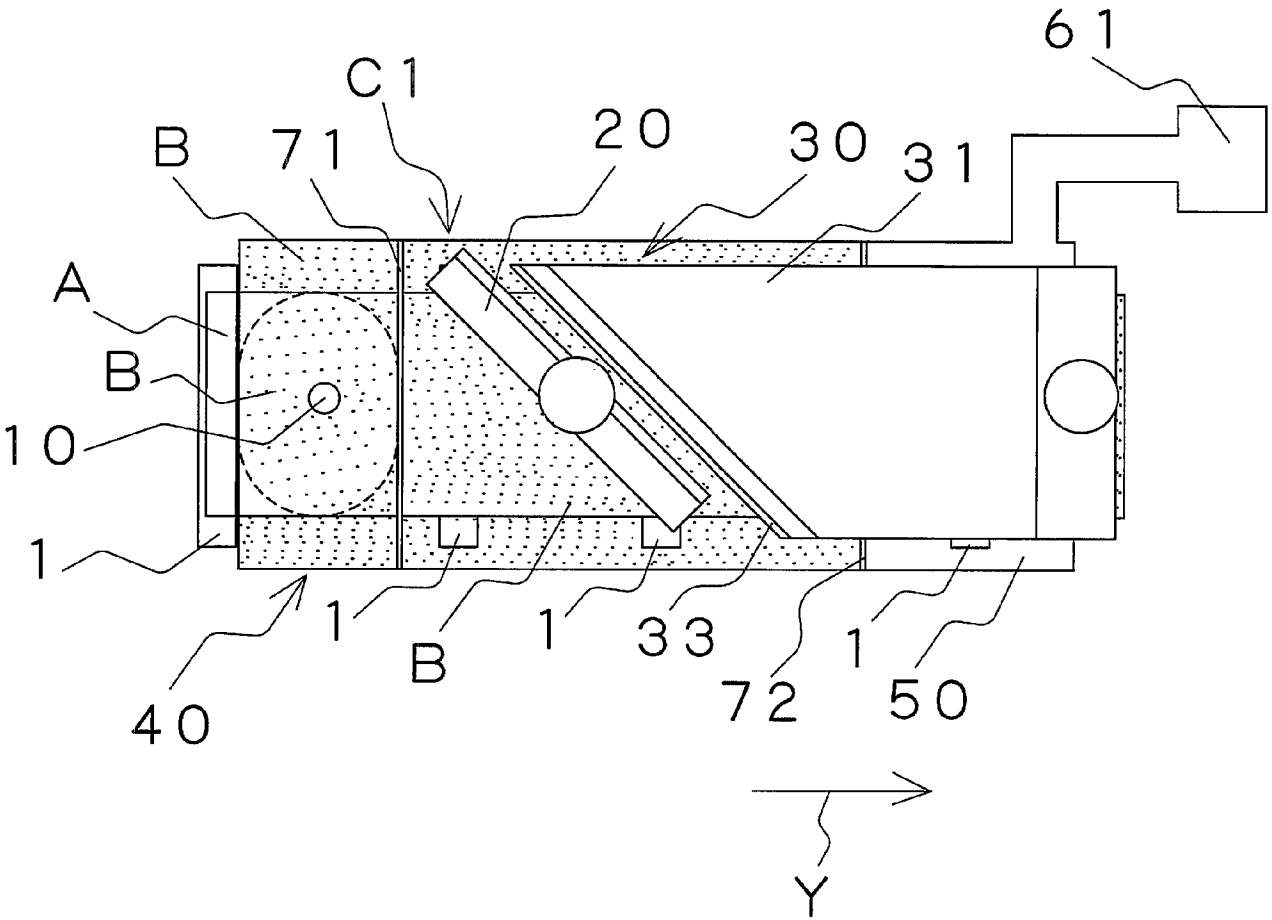
FIG. 2 is a cross-sectional diagram in which the cross section of the equipment taken along the line 1-1' in FIG. 1 is viewed from above.

FIG. 1 is a side cross-sectional diagram showing an example of the equipment having a coating apparatus of the present invention. FIG. 2 is across-sectional diagram in which the cross section of the equipment taken along the line 1-1' in FIG. 1 is viewed from above.

In the equipment shown in FIG. 1, a building board A is placed on a conveyance line with a surface of the building board A facing upward. The building board A is conveyed on the conveyance line in a direction of the arrow Y by rotating a conveyance roller 1 in a direction of the arrow X. Note that the building board is 3030 mm long and 463 mm wide and conveyed such that the width thereof perpendicular to a traveling direction of the building board A is 463 mm.

The conveyance line is provided with a coating apparatus C1 of a housing, and the building board A passes through the inside of the coating apparatus C1, with the surface of the building board A facing upward. The coating apparatus C1 has a spray 10, air knife 20, air blowing chamber 30, coating material recovering chamber 40, and decompression chamber 50. In the coating apparatus C1, the spray 10, air knife 20 and air blowing chamber 30 are provided on the upper side of the conveyance line, from a conveying-in port side to a conveying-out port side, and the spray 10 and the air knife 20 are separated by a wall 71. On the other hand, in the coating apparatus C1, the coating material recovering chamber 40 and the decompression chamber 50 are provided on the lower side of the conveyance line, from the conveying-in port side to the conveying-out port side, and the coating material recovering chamber 40 and the decompression chamber 50 are separated by a wall 72. Note that the coating apparatus C1 is formed into the housing in order to prevent the coating material from spattering to the outside.

The spray 10 is an application device for applying a coating material B to the surface of the building board A and capable of spraying the supplied coating material B from a nozzle. In the present equipment, when the building board A passes through below the spray 10, the nozzle sprays the coating material B to apply the coating material B to the surface of the building board A in an amount of 50 g/square 'shaku' (11.93 inches or 303 mm) or more, so that the coating material can be sufficiently applied to the surface of the building board A without forming an uncoated area.

The air knife 20 is a removal device that removes excess coating material applied to the surface of the building board A to form a coating liquid film. Air is supplied from a blower chamber 61 to an air distribution chamber 62, and a leading end nozzle of the air knife 20 can blow high-pressure air. In the present equipment, when the building board A applied with the coating material B by the spray 10 passes through below the air knife 20, the air is blown out from the leading end nozzle to remove the excess coating material on the surface of the building board A, whereby the coating liquid film with uniform thickness can be formed. As shown in FIG. 2, the width of the air knife 20 perpendicular to the traveling direction is greater than the width of the building board A perpendicular to the traveling direction, and the air knife 20 is installed so that it diagonally crosses the building board A with respect to the traveling direction. Therefore, the air is blown onto the building board A in a state in which the air knife crosses diagonally with respect to the traveling direction. When the high-pressure air is blown in this state, the excess coating material diagonally crosses the building board A and eventually falls from an end part of the building board A. Accordingly, the excess coating material can be removed reliably and the coating liquid film can be formed. Even when an uncoated area is formed on the building board A, the coating material can be replenished by the excess coating material, whereby the coating liquid film can be formed.

Note that the spray 10 and the air knife 20 are separated by the wall 71 in order to prevent the spray 10 from being affected by the air from the air knife 20 or the coating material B spattered by the air knife 20.

The air blowing chamber 30, which is a pressure device for blowing the air to the coating liquid film formed on the surface of the building board A, has an air outlet 31 and a straightening plate 32 and is capable of supplying the air from the blower chamber 61 through the air distribution chamber 62 and blowing the air from the air outlet 31. The air blown from the air outlet 31 is straightened by the straightening plate 32, whereby the air can be blown from the entire air outlet 31. As shown in FIG. 2, the width of the air outlet 31 perpendicular to the traveling direction is greater than the width of the building board A perpendicular to the traveling direction, and, as shown in FIG. 1, the air outlet 31 covers a lateral face of the building board A as well. When blowing the air from the air outlet 31 in this state, not only is it possible to reliably blow the air onto the entire surface of the building board A, but also to prevent the coating material spattered by the air knife 20 from adhering to the surface and lateral face of the building board A. In the present equipment, the excess coating material is removed by the air knife 20, and the air can be blown from the air outlet 31 when the building board A formed with the coating liquid film passes through below the air blowing chamber 30. By blowing the air using the air blowing chamber 30, the coating material B is pressed in the internal direction of the surface of the building board A and thereby fill fine concave and convex portions of the surface of the building board A. As a result, the thickness of the coating liquid film formed on the surface of the building board A can be further uniformed, thereby improving the adhesion of the coating material B to the building board A. Because the air blowing chamber 30 is provided on the conveying-out port side from the air knife 20, a leading end of the air outlet 31 is formed such that it diagonally crosses the building board A in accordance with the installed state of the air knife 20. In addition, a front end part of the air outlet 31 has an angle 33 having an L-shaped cross section. With this angle 33, even when the coating material removed and spattered by the air knife 20 adheres to the air outlet 31, especially to an upper surface of the air outlet 31, the adhering coating material flows laterally along the angle 33 and falls from a lateral end part of the air outlet 31. Thus, the coating material can be prevented from dripping from the front end part and adhering to the surface of the building board. In this manner, the appearance of the building board A is prevented from being damaged.

Although there is a slight gap between the air knife 20 and the air blowing chamber 30, in the present equipment the air knife 20 and the air blowing chamber 30 are contained in one section of one housing, and both the air knife 20 and the air blowing chamber 30 pressurize the surface of the building board A. Therefore, the whole section is in a pressurized state, and the surface of the building board A is applied with pressure of the atmospheric pressure or higher during a time period in which the building board A is conveyed from the air knife 20 to the air blowing chamber 30.

The coating material recovering chamber 40 is a device for recovering the coating material B that is sprayed from the spray 10 but is not applied to the building board A, as well as the coating material B that is removed by the air knife 20. In the present equipment, when the building board A passes through above the coating material recovering chamber 40, the coating material recovering chamber 40 recovers the coating material B that is sprayed from the spray 10 but is not applied to the building board A, as well as the coating material B that is removed by the air knife 20. The recovered coating material B is filtered by a metallic mesh (not shown) and supplied to the spray 10 again by a pump 41.

The decompression chamber 50, which is a decompression device for decompressing a back side of the building board A, is capable of depressurizing the inside of the decompression chamber 50 by sending the air within the decompression chamber 50 to the blower chamber 61, to decompress the back side of the building board A. In the present equipment, when the building board A passes through above the decompression chamber 50, the decompression chamber 50 depressurizes the inside of the decompression chamber 50 by sending the air within the decompression chamber 50 to the blower chamber 61, to decompress the back side of the building board A. Because the decompression chamber 50 is located below the air blowing chamber 30, the coating material B is pressed in the internal direction of the surface of the building board A and at the same time pulled toward the back side. Therefore, the fine concave and convex portions of the surface of the building board A can be filled with the coating material B more easily, and the thickness of the coating liquid film formed on the surface of the building board A can be further uniformed, thereby further improving the adhesion of the coating material B to the building board A. Moreover, because the upper side of the decompression chamber 50 is partially covered by the air outlet 31, the air can be drawn stably at the time of decompression.

Next, a coating method using the equipment shown in FIGS. 1 and 2 is described.

First, the conveyance roller 1 is rotated in the direction of the arrow X to convey the building board A on the conveyance line in the direction of the arrow Y with the surface of the building board A facing upward. When the building board A passes through below the spray 10, the coating material B is sprayed from the nozzle of the spray 10 and then applied to the surface of the building board A in an amount of 50 g/square 'shaku' (11.93 inches or 303 mm) or more. By applying the coating material B using the spray 10, the surface of the building board A can be coated sufficiently without forming an uncoated area. Note that the coating material B that is sprayed by the spray 10 but is not applied to the building board A is recovered by the coating material recovering chamber 40.

Subsequently, when the building board A passes through below the air knife 20, the building board A having the surface applied with the coating material B by the spray 10, the air is blown from the leading end nozzle of the air knife 20 to remove the excess coating material on the surface of the building board A, whereby the coating liquid film with uniform thickness is formed on the surface of the building board A. As described above, the width of the air knife 20 perpendicular to the traveling direction is greater than the width of the building board A perpendicular to the traveling direction, and the air knife 20 is installed such that it diagonally crosses the building board with respect to the traveling direction. Further, the air is blown onto the building board A in a state in which the air knife crosses diagonally with respect to the traveling direction. Therefore, the excess coating material diagonally crosses the building board A and eventually falls from the end part of the building board A. Accordingly, the excess coating material is removed reliably and the coating liquid film with uniform thickness is formed. In addition, when the building board A has an uncoated area, the coating material is replenished by the excess coating material, forming the coating liquid film. Note that the coating material B that is removed by the air knife 20 is recovered by the coating material recovering chamber 40.

The excess coating material is removed by the air knife 20. When the building board A having the coating liquid film formed thereon passes through blow the air blowing chamber 30, the air is blown from the air outlet 31. As described above, the air blown from the air outlet 31 is straightened by the straightening plate 32 and then blown from the entire air outlet 31. Further, the width of the air outlet 31 perpendicular to the traveling direction is greater than the width of the building board A perpendicular to the traveling direction, and the air outlet 31 covers a lateral face of the building board A as well. Thus, the coating material spattered by the air knife 20 is prevented from adhering to the surface and lateral face of the building board A, and the air is reliably blown onto the entire surface of the building board A. By blowing the air, the coating material B is pressed in the internal direction of the surface of the building board A and thereby fills the fine concave and convex portions of the surface of the building board A. As a result, the thickness of the coating liquid film formed on the surface of the building board A can be further uniformed, and the adhesion of the coating material B to the building board A is improved.

Moreover, when the building board A passes through above the decompression chamber 50, the air within the decompression chamber 50 is sent to the blower chamber 61 to depressurize the decompression chamber 50, whereby the back side of the building board A is decompressed. As described above, because the decompression chamber 50 is located below the air blowing chamber 30, the coating material B is pressed in the internal direction of the surface of the building board A and at the same time pulled toward the back side. Therefore, the fine concave and convex portions of the surface of the building board A can be filled with the coating material B more easily, and the thickness of the coating liquid film formed on the surface of the building board A can be further uniformed, thereby further improving the adhesion of the coating material B to the building board A. In addition, because the upper side of the decompression chamber 50 is always partially covered by the air outlet 31, the air can be drawn stably at the time of decompression.

Another example of the equipment of the present invention is described.

Figure 3:
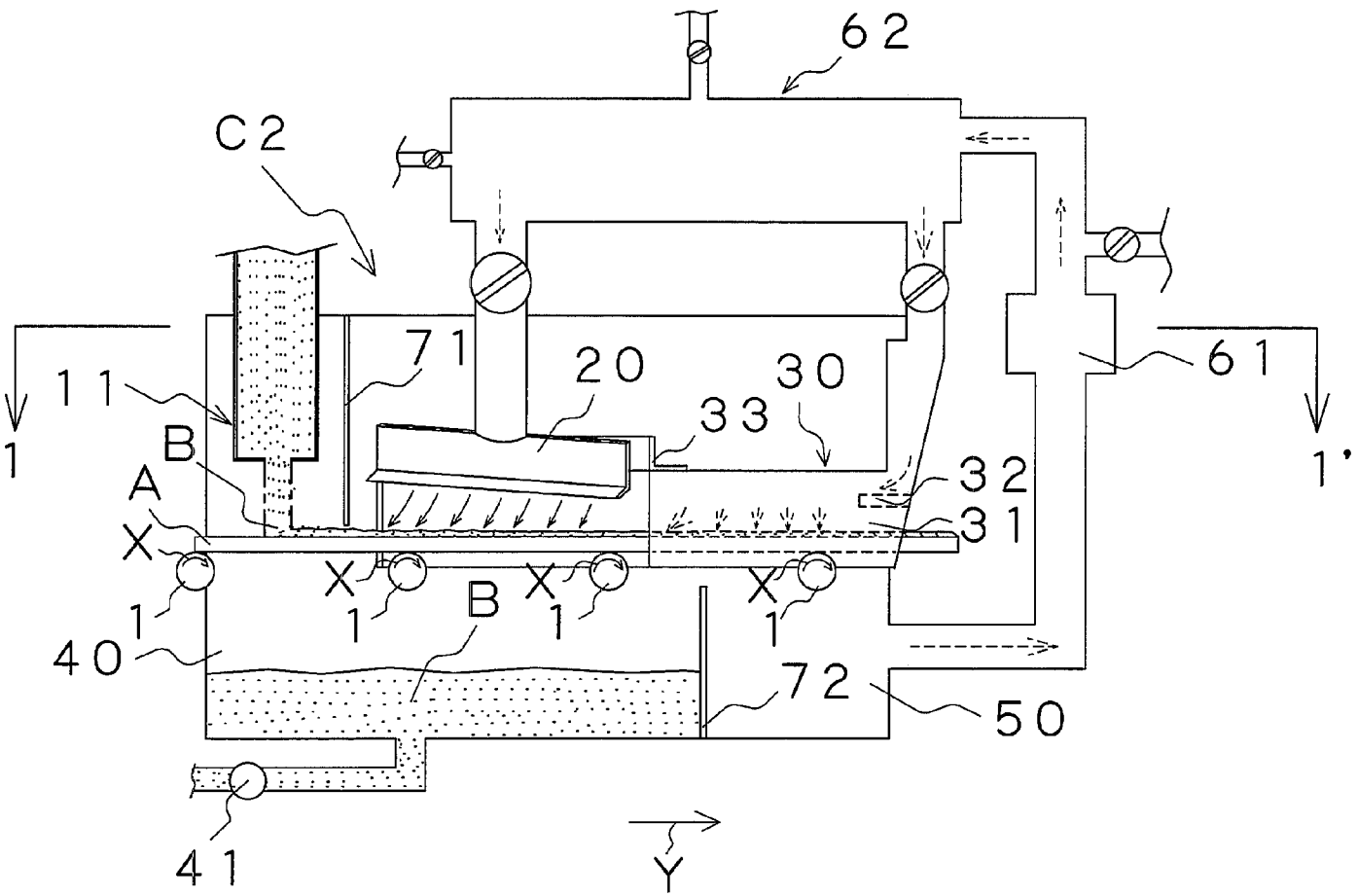
FIG. 3 is a side cross-sectional diagram showing another example of the equipment having a coating apparatus of the present invention.
Figure 4:
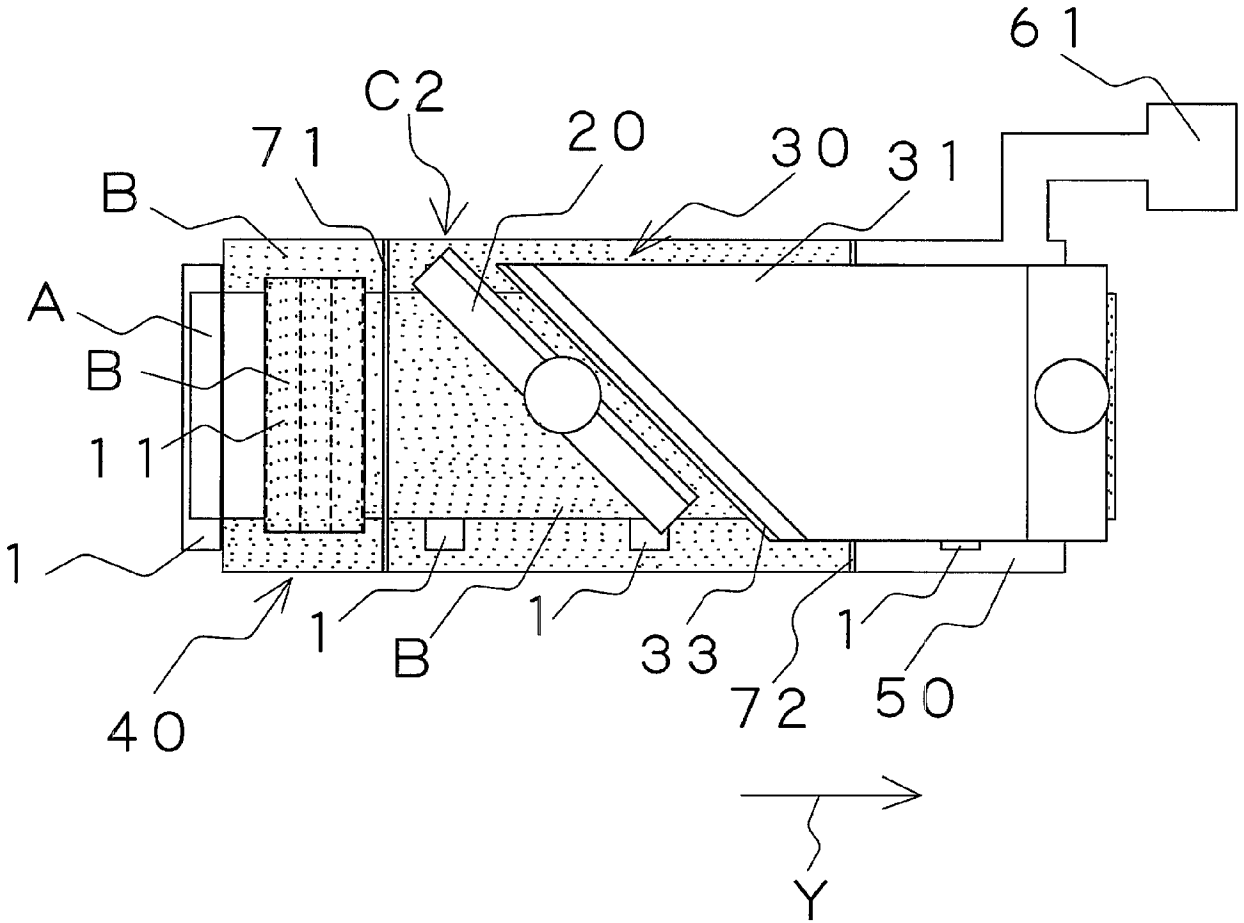
FIG. 4 is a cross-sectional diagram in which the cross section of the equipment taken along the line 1-1' in FIG. 3 is viewed from above.

FIG. 3 is a side cross-sectional diagram showing another example of the equipment having a coating apparatus of the present invention. FIG. 4 is a cross-sectional diagram in which the cross section of the equipment taken along the line 1-1' in FIG. 3 is viewed from above.

The conveyance line is provided with a coating apparatus C2 of a housing, and the building board A passes through the inside of the coating apparatus C2, with the surface of the building board A facing upward. The coating apparatus C2 is same as the coating apparatus C1 shown in FIGS. 1 and 2, except that the spray 10 of the coating apparatus C1 is changed to a flow coater 11. Specifically, the coating apparatus C2 has the flow coater 11, air knife 20, air blowing chamber 30, coating material recovering chamber 40 and decompression chamber 50. In the coating apparatus C2, the flow coater 11, air knife 20 and air blowing chamber 30 are provided on the upper side of the conveyance line, from the conveying-in port side to the conveying-out port side, and the flow coater 11 and the air knife 20 are separated by the wall 71. On the other hand, in the coating apparatus C2, the coating material recovering chamber 40 and the decompression chamber 50 are provided on the lower side of the conveyance line, from the conveying-in port side to the conveying-out port side, and the coating material recovering chamber 40 and the decompression chamber 50 are separated by the wall 72.

In the present equipment, the flow coater 11 is used to apply the coating material B to the surface of the building board A in an amount of 50 g/square 'shaku' (11.93 inches or 303 mm) or more, and the surface of the building board A can be coated sufficiently without forming an uncoated area. Note that the coating material B that flows down from the flow coater 11 but is not applied to the building board A is recovered by the coating material recovering chamber 40.

The air knife 20, air blowing chamber 30, coating material recovering chamber 40 and decompression chamber 50 are the same as those of the equipment shown in FIGS. 1 and 2, wherein, as with the equipment shown in FIGS. 1 and 2, the coating material B can be sufficiently applied to the surface of the building board A without forming an uncoated area, and the thickness of the coating liquid film formed on the surface of the building board A can be uniformed.

Next, a coating method using the equipment shown in FIGS. 3 and 4 is described.

Because the spray 10 is changed to the flow coater 11 in the equipment shown in FIGS. 1 and 2, in the equipment shown in FIGS. 3 and 4 the flow coater 11 is used to apply the coating material B to the surface of the conveyed building board A in an amount of 50 g/square 'shaku' (11.93 inches or 303 mm) or more. By applying the coating material B by means of the flow coater 11, the surface of the building board A can be sufficiently coated without forming an uncoated area. Note that the coating material B that flows down from the flow coater 11 but is not applied to the building board A is recovered by the coating material recovering chamber 40.

The rest of the equipment shown in FIGS. 3 and 4 are the same as the equipment shown in FIGS. 1 and 2. Therefore, the coating method performed subsequently to the flow coater 11 is the same as the abovementioned coating method that uses the equipment shown in FIGS. 1 and 2. Specifically, the excess coating material on the surface of the building board A is removed by the air knife 20 to form the coating liquid film. Next, the air is blown from the air outlet 31 of the air blowing chamber 30 onto the coating liquid film of the building board A. Further, the air within the decompression chamber 50 is sent to the blower chamber 61 to depressurize the decompression chamber 50, whereby the back side of the building board A is decompressed. Note that the coating material B removed by the air knife 20 is also recovered by the coating material recovering chamber 40.

As with the coating method that uses the equipment shown in FIGS. 1 and 2, in the coating method using the equipment shown in FIGS. 3 and 4, not only is it possible to sufficiently apply the coating material B to the surface of the building board A without forming an uncoated area, but also to further uniform the thickness of the coating liquid film formed on the surface of the building board A and to improve the adhesion of the coating material B to the building board A.

Yet another example of the equipment of the present invention is described.

Figure 5:
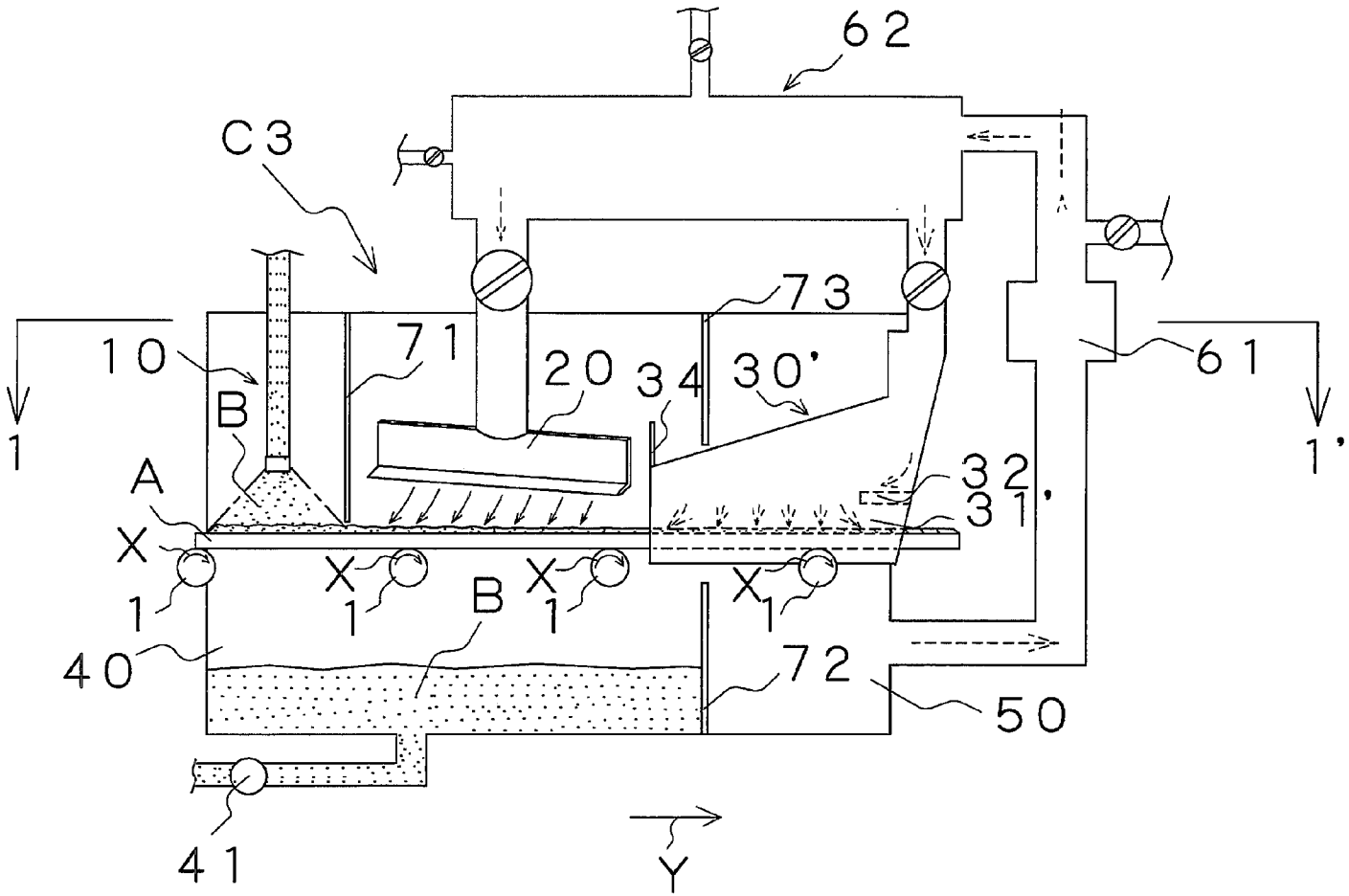
FIG. 5 is a side cross-sectional diagram showing yet another example of the equipment having a coating apparatus of the present invention.
Figure 6:
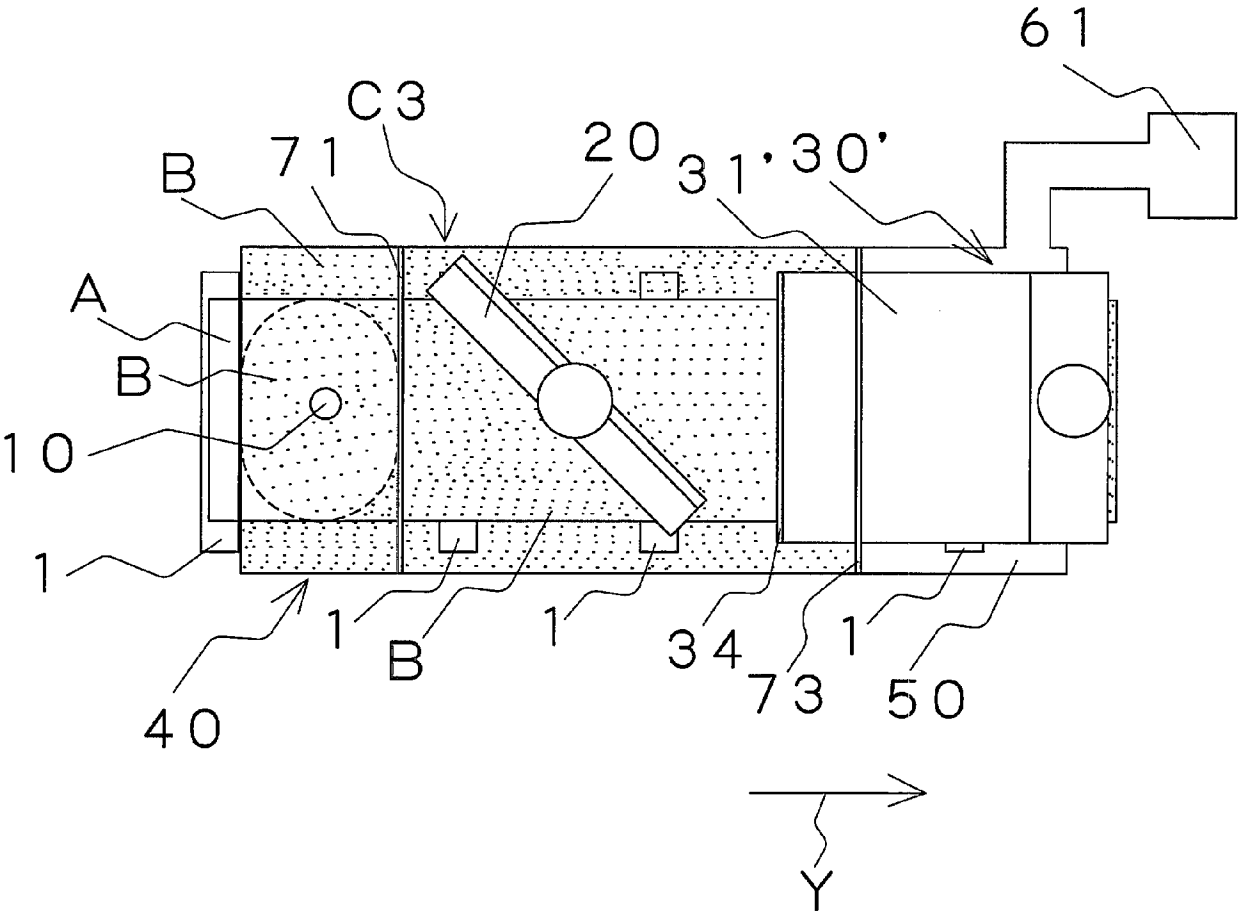
FIG. 6 is a cross-sectional diagram in which the cross section of the equipment taken along the line 1-1' in FIG. 5 is viewed from above.

FIG. 5 is a side cross-sectional diagram showing yet another example of the equipment having a coating apparatus of the present invention. FIG. 6 is a cross-sectional diagram in which the cross section of the equipment taken along the line 1-1' in FIG. 5 is viewed from above.

The conveyance line is provided with a coating apparatus C3 of a housing, and the building board A passes through the inside of the coating apparatus C3, with the surface of the building board A facing upward. The coating apparatus C3 is same as the coating apparatus C1 shown in FIGS. 1 and 2, except that the shape of the air blowing chamber 30 is changed to air blowing chamber 30' by changing shape, that a bent part 34 is provided in place of the angle 33, and that a wall 73 is added. The bent part 34 is formed at the front end part of the air outlet and bent upward. The wall 73 is provided above the air outlet 31' and on the conveying-out port side from the bent part 34. The wall 73 is capable of preventing the coating material B spattered by the air knife 20 from moving toward the conveying-out port side from the wall 73, and of alleviating the adhesion of the coating material B to the air blowing chamber 30'. Although the coating material B adhering to the wall 73 drips onto the upper surface of the air outlet 31', the coating material B on the upper surface of the air outlet 31' moves in the direction of the front end part, because the upper surface of the air outlet 31' is tilted. Because the bent part 34 is formed at the front end part, the coating material B is caused to flow in the lateral direction by this bent part 34 and falls from the lateral end part of the air outlet 31'.

In addition, the coating apparatus C3 has the spray 10, air knife 20, air blowing chamber 30', coating material recovering chamber 40, and decompression chamber 50. In the coating apparatus C3, the spray 10, air knife 20 and air blowing chamber 30' are provided on the upper side of the conveyance line, from the conveying-in port side to the conveying-out port side, and the spray 10 and the air knife 20 are separated by the wall 71. On the other hand, in the coating apparatus C3, the coating material recovering chamber 40 and the decompression chamber 50 are provided on the lower side of the conveyance line, from the conveying-in port side to the conveying-out port side.

The spray 10, air knife 20, coating material recovering chamber 40 and decompression chamber 50 are the same as those of the equipment shown in FIGS. 1 and 2, and air blowing chamber 30' can blow air from the entire air outlet 31' to the coating liquid film on the surface of the building board, wherein, as with the equipment shown in FIGS. 1 and 2, the coating material B can be sufficiently applied to the surface of the building board A without forming an uncoated area, and the thickness of the coating liquid film formed on the surface of the building board A can be uniformed.

Next, a coating method using the equipment shown in FIGS. 5 and 6 is described.

As with the coating method using the equipment shown in FIGS. 1 and 2, in the coating method using equipment shown in FIGS. 5 and 6 the coating material B is applied to the surface of the building board A by means of the spray 10, and the excess coating material B is removed by the air knife 20 to form the coating liquid film on the surface of the building board A. Then, the air is blown from the air outlet 31' onto the coating liquid film formed on the surface of the building board A. Further, the air within the decompression chamber 50 is sent to the blower chamber 61 to depressurize the decompression chamber 50, whereby the back side of the building board A is decompressed. Note that the coating material recovering chamber 40 recovers the coating material B that is sprayed by the spray 10 but is not applied to the building board A, as well as the coating material removed by the air knife 20.

As with the coating method using the equipment shown in FIGS. 1 and 2, in the coating method using the equipment shown in FIGS. 5 and 6, not only is it possible to sufficiently apply the coating material B to the surface of the building board A without forming an uncoated area, but also to further uniform the thickness of the coating liquid film formed on the surface of the building board A and to improve the adhesion of the coating material B to the building board A.

The above has described an embodiment of the present invention, but the present invention is not limited to this embodiment, and various changes can be made within the scope of the inventions described in the patent claims. For example, the coating apparatus is not necessary formed as one housing, and may be provided in the spray, the air knife, and the air blowing chamber. Moreover, as the removal device, a plurality of narrow air knives may be installed, and the excess coating material on the surface of the building board may be removed by using the plurality of air knives. In addition, a roll coater or the like may be installed in place of the air knife, and the excess coating material may be removed by bringing the roll coater or the like into contact with the surface of the building board.

According to the coating apparatus of the present invention described above, even in the case of a building board with an uneven surface, a coating material can be sufficiently applied to the surface of the building board without forming an uncoated area, while conveying the building board. It is also possible to uniform the thickness of a coating film to be formed on the surface of the building board. Further, the adhesion of the coating film to the building board can be improved. Moreover, spattered coating material can be prevented from adhering to the surface of the building board.

What is claimed is:

1. A coating apparatus for coating a surface of a building board while conveying the building board with the surface facing upward, the coating apparatus comprising:

an housing having a inlet and an outlet so that a building board is conveyed through the inlet and outlet;

a conveyance line for conveying the building board, the conveyance line being disposed so that the building board is conveyed through the inlet and the outlet of the housing;

an application device for applying a coating material toward the conveyance line, the application device being disposed so that the coating material is applied to the surface of the building board;

a removal device for blowing high-pressure air toward the conveyance line, the removal device being disposed so that an excess coating material applied to the surface of the building board is removed by high-pressure air, thereby forming a coating liquid film on the surface of the building board;

a pressure device for blowing air toward the conveyance line, the pressure device having an air chamber having an air outlet from which air is blown and being disposed so that the air is applied to the coating liquid film on the surface of the building board;

a decompression device for reducing air pressure under the conveyance line; and a coating material recovering chamber, wherein the removal device, the pressure device, the coating material recovering chamber, and the decompression device are disposed in the housing, the application device, the removal device, and the pressure device are disposed in order from the inlet to the outlet of the housing and above the conveyance line, the application device can feed 50-200 g/shaku$^2$ to the surface of the building board to be coated, where one shaku is 303 mm, the removal device is disposed at an angle toward the conveyance line and to be separated from the application device, the pressure device is disposed adjacent to the removal device so that atmospheric air pressure or higher is applied on the conveyance line while the building board is conveyed from the removal device to the pressure device, the air outlet of the pressure device is wider than the conveyance line so that the blown air covers the surface of the building board to be coated, the coating material recovering chamber and the decompression device is disposed under the conveyance line and in order from the inlet to the outlet, the coating material recovering chamber is disposed beneath the application device and the removal device so as to recover the coating material, the decompression device is disposed so that pressure under the conveyance line is reduced by inhaling air from inside of the housing and exhaling air to outside of the housing, and the decompression device is disposed beneath the pressure device and separated from the coating material recovering chamber.

2. The coating apparatus for coating a building board according to claim 1, wherein the air outlet of the pressure device has downwardly extending portions, each of the downwardly extending portions being disposed along the conveyance line so that side surfaces of the building board to be conveyed on the conveyance line are covered by the downwardly extending portions.

3. The coating apparatus for coating a building board according to claim 1 or 2, wherein the pressure device further comprises a straightening plate above the air outlet so as to regulate an air flow.

4. The coating apparatus for coating a building board according to claim 1, wherein the pressure device further comprises a coating stopper for preventing the coating material which is spattered by the removal device and adheres to an upper surface of the pressure device from dripping from the upper surface of the pressure device to the surface of the building board, the coating stopper being disposed at a front end part of the pressure device and above the air outlet of the pressure device.

* * * * *